US007744197B2

(12) United States Patent
Yamada et al.

(10) Patent No.: US 7,744,197 B2
(45) Date of Patent: Jun. 29, 2010

(54) METHOD FOR MANUFACTURING INKJET RECORDING HEAD OF INKJET RECORDING DEVICE

(75) Inventors: Takahiro Yamada, Hitachinaka (JP); Satoru Tobita, Hitachinaka (JP); Hitoshi Kida, Hitachinaka (JP); Kenichi Kugai, Hitachinaka (JP); Nobuhiro Kurosawa, Hitachinaka (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 932 days.

(21) Appl. No.: 11/382,785

(22) Filed: May 11, 2006

(65) Prior Publication Data

US 2006/0268072 A1 Nov. 30, 2006

(30) Foreign Application Priority Data

May 13, 2005 (JP) ..... P2005-141058

(51) Int. Cl.
*B41J 2/045* (2006.01)
*B41J 29/393* (2006.01)

(52) U.S. Cl. ..... 347/68; 347/19

(58) Field of Classification Search ..... 347/11
See application file for complete search history.

(56) References Cited

U.S. PATENT DOCUMENTS

2003/0048331 A1* 3/2003 Takahashi et al. ..... 347/57

FOREIGN PATENT DOCUMENTS

JP 2001-277525 10/2001

* cited by examiner

*Primary Examiner*—Matthew Luu
*Assistant Examiner*—Lisa M Solomon
(74) *Attorney, Agent, or Firm*—Whitham Curtis Christofferson & Cook, PC

(57) ABSTRACT

A method for manufacturing an inkjet recording head includes an ejecting step, a measuring step, dividing step and applying step. The ejecting step ejects test ink droplets and print ink droplets from nozzles. The measuring step measures ejection results of the test ink droplets. The dividing step divides a plurality of nozzles into a plurality of groups based on the ejection results. The applying step applies a group-based polarizing voltage determined for each group to the piezoelectric elements belonging to a corresponding group to polarize the piezoelectric elements so that ejection results of the print ink droplets fall in a predetermined range.

10 Claims, 6 Drawing Sheets

METHOD FOR MANUFACTURING INKJET RECORDING HEAD OF INKJET RECORDING DEVICE

BACKGROUND OF THE INVENTION

1. Field of the Invention

The present invention relates to an ink jet recording head for recording a high-quality image at high speed with high reliability and an ink jet recording device equipped with the recording head, a manufacturing method of the recording head of the inkjet recording device.

2. Description of Related Art

For recording a high-quality image at high speed with high reliability by using a multi-nozzle on-demand ink jet recording head in which a lot of nozzles are integrated, it is important to reduce variations in the ink drop discharge speed or the ink drop weight among nozzles.

In an on-demand ink jet recording head according to push-type piezoelectric element system, a wall of an ink pressurizing chamber having nozzle apertures is formed of a diaphragm. By pushing the diaphragm with vertical vibrations of rod-like piezoelectric elements, the volume of the ink pressurizing chamber is decreased to discharge the ink drop. Conventionally, in the on-demand ink jet recording head according to push-type piezoelectric element system, in order to reduce variations in the ink drop discharge speed or weight among nozzles, the accuracy of components such as the piezoelectric elements and the ink pressurizing chamber is improved, or assembling accuracy of bonding of each part and the like is improved.

However, according to the above-mentioned method, there may cause disadvantages such as an increase in costs of parts and assembling time. On the contrary, Unexamined Patent Application Publication No. 2001-277525 discloses a method of reducing variations in the ink drop discharge speed or weight among nozzles by properly adjusting the polarization level of piezoelectric elements. According to this method, although it requires adjustment costs in a head manufacturing process, variations in the ink drop discharge speed and weight can be improved without adding any part or circuit.

However, according to the method disclosed in Unexamined Patent Publication No. 2001-277525, the ink discharge speed needs to be measured while varying a polarization level of each piezoelectric element in order to adjust the ink drop discharge speed of each nozzle of a recording head to a target speed. For this reason, since it takes time to measure the ink drop discharge speed and adjust the polarization level of the piezoelectric elements to a proper value, sufficient cost down and improvement in productivity cannot be achieved.

SUMMARY OF THE INVENTION

In view of the above-described drawbacks, it is an objective of the present invention to provide an on-demand ink jet recording head in which a lot of nozzles are integrated, a manufacturing method of the head and a recording device, which can record high-quality images at high speed at low costs.

In order to attain the above and other objects, the present invention provides a method for manufacturing an inkjet recording head including a plurality of nozzles and a plurality of piezoelectric elements provided in one-to-one correspondence with the plurality of nozzles. Each piezoelectric element expands and contracts in accordance with a driving voltage applied thereto and polarizes in accordance with a polarizing voltage applied to thereto. The method includes an ejecting step, a measuring step, dividing step and an applying step. The ejecting step ejects test ink droplets and print ink droplets from the nozzles. The measuring step measures ejection results of the test ink droplets. The dividing step divides the plurality of nozzles into a plurality of groups based on the ejection results. The applying step applies a group-based polarizing voltage determined for each group to the piezoelectric elements belonging to a corresponding group to polarize the piezoelectric elements so that ejection results of the print ink droplets fall in a predetermined range.

Another aspect of the present invention provides an inkjet recording head including a plurality of piezoelectric elements and a plurality of nozzles provided one-to-one correspondence with the plurality of piezoelectric elements. The plurality of piezoelectric elements expands and contracts based on a driving voltage applied thereto, and polarizes in accordance with a polarizing voltage applied to thereto. Each nozzle ejects test ink droplets and print ink droplets in accordance with the expansion and the contraction of the corresponding piezoelectric element. The plurality of nozzles are divided into a plurality of groups based on an ejection result of the test ink droplets. The group-based polarizing voltage determined for each group is applied to the piezoelectric elements belonging to a corresponding group to polarize the piezoelectric elements so that ejection results of the print ink droplets fall in a predetermined range.

Another aspect of the present invention provides an inkjet recording device including a body and an inkjet recording head provided on the body. The inkjet recording head includes a plurality of piezoelectric elements and a plurality of nozzles provided one-to-one correspondence with the plurality of piezoelectric elements. The plurality of piezoelectric elements expands and contracts based on a driving voltage applied thereto, and polarizes in accordance with a polarizing voltage applied to thereto. Each nozzle ejects test ink droplets and print ink droplets in accordance with the expansion and the contraction of the corresponding piezoelectric element. The plurality of nozzles are divided into a plurality of groups based on an ejection result of the test ink droplets. The group-based polarizing voltage determined for each group is applied to the piezoelectric elements belonging to a corresponding group to polarize the piezoelectric elements so that ejection results of the print ink droplets fall in a predetermined range.

BRIEF DESCRIPTION OF THE DRAWINGS

The above and other objects, features and advantages of the invention will become more apparent from reading the following description of the preferred embodiments taken in connection with the accompanying drawings in which.

DETAILED DESCRIPTION OF THE PREFERRED EMBODIMENTS

Figure 1:
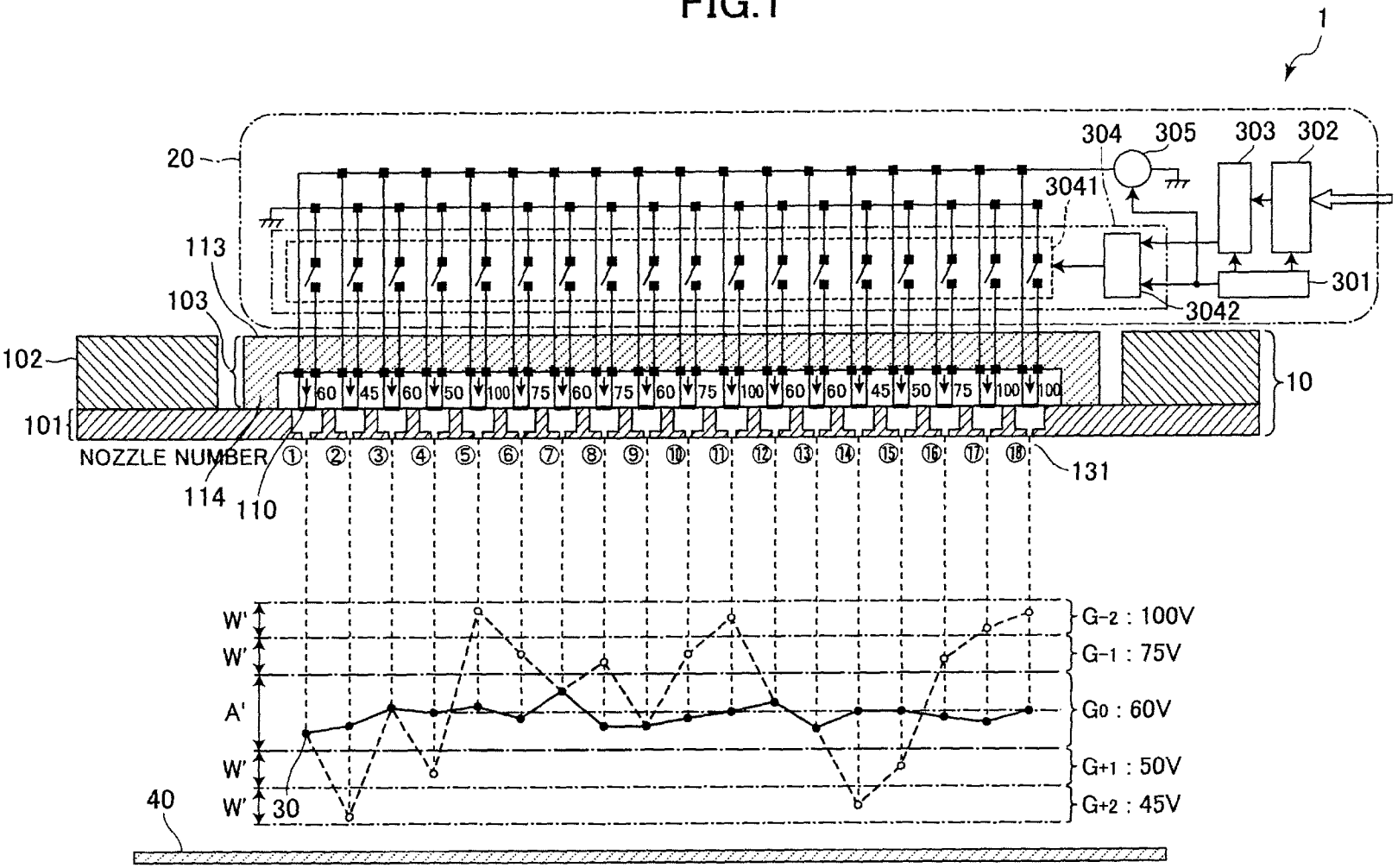
FIG. 1 is a configuration view for describing the configuration and operation of a recording device in a first embodiment of the present invention.
Figure 2:
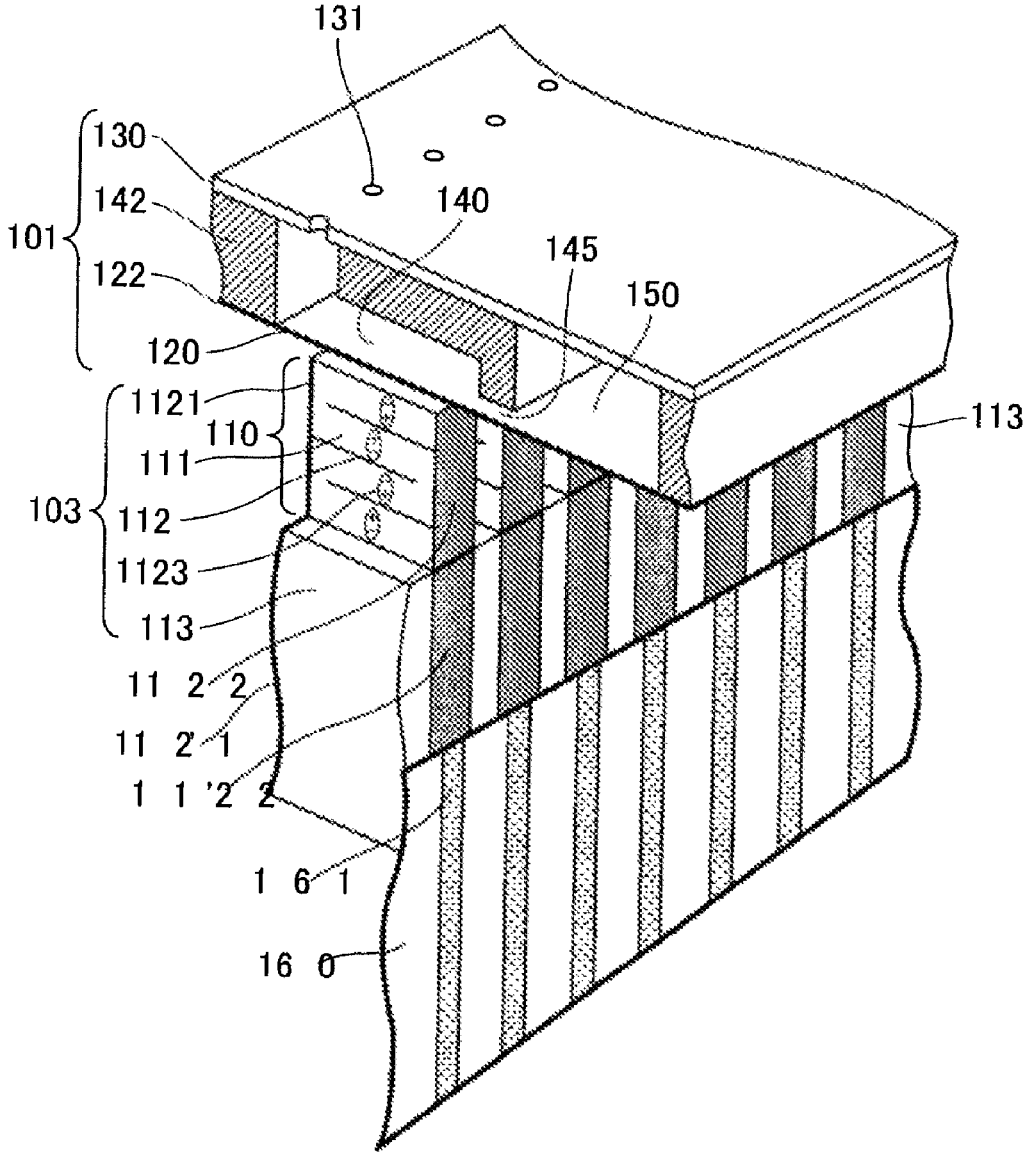
FIG. 2 is a partial perspective enlarged view for describing the configuration and operation of a recording head in the first embodiment of the present invention.

A recording device according to preferred embodiments of the present invention will be described while referring to FIG. 1 to FIG. 5 wherein like parts and components are designated by the same reference numerals to avoid duplicating description. FIG. 1 is a view for describing the configuration and operation of a recording device 1 in accordance with this embodiment. FIG. 2 is a partial perspective view for describing the configuration and operation of a recording head 10. Note that the upper side in FIG. 2 corresponds to the lower side in FIG. 1.

As shown in FIG. 1, the recording device 1 in this embodiment includes the recording head 10 and a recording head driving device 20. The recording head 10 has an ink passage unit 101, a head housing 102 and a piezoelectric element unit 103. The head housing 102 holds the ink passage unit 101. As shown in FIG. 2, the ink passage unit 101 includes an orifice plate 130, an ink passage forming plate 142 and a diaphragm forming plate 122. These plates are laminated in this order. The piezoelectric element unit 103 includes rod-like piezoelectric elements 110 (hereinafter referred to as piezoelectric elements) and a piezoelectric element supporting substrate 113. As shown in FIG. 2, the piezoelectric elements 110 are fixed to the piezoelectric element supporting substrate 113 in a comb-like fashion.

A supporting substrate fixing part 114 (FIG. 1) is provided at each end of the piezoelectric element supporting substrate 113 in the aligning direction of the piezoelectric elements 110 and the bottom face of the supporting substrate fixing part 114 is fixedly adhered to the ink passage unit 101. The ink passage unit 101 is fixedly adhered to the head housing 102 in the vicinity of the above-mentioned adhered region. This results in that the bottom face of the piezoelectric element supporting substrate fixing part 114 is fixed to the head housing 102.

The orifice plate 130, the ink passage forming plate 142 and the diaphragm forming plate 122 form an ink pressurizing chamber 140, an ink inflow port 145 for guiding ink into the ink pressurizing chamber 140 and a common ink chamber 150 for supplying ink to the ink inflow port 145. Nozzle apertures 131 (hereinafter referred to as nozzle 131) are aligned on a face of the orifice plate 130 opposed to the ink pressurizing chamber 140 at a predetermined pitch. The nozzles each have the same configuration. One end of each piezoelectric element 110 is attached to a face of a diaphragm 120 on the opposite side of the ink pressurizing chamber 140 through an adhesive layer.

Each piezoelectric element 110, as shown in FIG. 2, has a layer configuration in which a plurality of laminar piezoelectric elements 111 are laminated through laminar electrodes 112. The laminar electrodes 112 are alternately connected to common electrodes 1121 and individual electrodes 1122 that are formed at side faces of the piezoelectric element 100. The common electrodes 1121 and the individual electrodes 1122 are connected to common electrodes 1121' and individual electrodes 1122' which are formed on the piezoelectric element supporting substrate 113, respectively. The common electrodes 1121' and the individual electrodes 1122' are connected to flexible cable terminals 161 of a flexible cable 160.

The recording head 10 with such configuration is driven by a signal sent from the recording head driving device 20 through the flexible cables 160. The recording head driving device 20 includes a timing signal generating circuit 301, a recording signal generating circuit 302, a driving signal generating circuit 303, a switching circuit 304 and a driving voltage generating circuit 305.

The recording signal generating circuit 302 generates a recording data signal according to recording signal input data sent from a host device not shown (for example, a personal computer). Based on the data signal and a timing signal sent from the timing signal generating circuit 301, the driving signal generating circuit 303 generates a driving data signal. The driving data signal controls turning ON/OFF of switching elements 3041 of the switching circuit 304. Since the switching elements 3041 are connected to the driving voltage generating circuit 305 that is a voltage source, a piezoelectric element driving pulse is applied to the piezoelectric elements 110 according to turning ON/OFF of the switching elements 3041. Thereby, the piezoelectric elements 110 connected to the switching elements 3041 that is turned ON are charged or discharged and driven by the piezoelectric element driving pulse to discharge ink drops.

When a polarization voltage (for example, 45 to 100 V) larger than a driving voltage for discharging an ink drop (for example, about 25 V) is applied between the common electrodes 1121 and the individual electrodes 1122 and the application is stopped, as shown in FIG. 2, residual polarization 1123 occurs in each piezoelectric element 111. In this embodiment, in an initial state, the residual polarization 1123 in each piezoelectric element 110 is assumed to be equal. By varying the magnitude of the residual polarization 1123, the ink drop discharge speed can be varied. The magnitude of the residual polarization can be adjusted by varying, for example, the magnitude of the polarization voltage and temperature at polarization. In this embodiment, the poralization voltage is varied under a constant temperature (repolarization) to adjust the polarization level of the piezoelectric elements.

Specifically, in this embodiment, as shown next to the piezoelectric elements 110 in FIG. 1, the polarization level is set for each piezoelectric element 110 in a phased manner. That is, in the recording head or recording device, when variations in the ink drop discharge speed among the nozzles 131 fall within the range of "A", the variations are defined to be allowable. In the case where the nozzles 131 are uniformly polarized at a certain polarization level, a group consisting of nozzles 131 having the ink drop discharge speed within the range "A" is defined as a group $G_0$ and the polarization level of the piezoelectric elements corresponding to the nozzles 131 in the group $G_0$ is collectively set as the same level $b_0$=b60. Nozzles 131 having the ink drop discharge speed outside the range "A" are divided into a plurality of groups $G_{+1-+n}$ and $G_{-1--n}$ depending on the magnitude of deviation of the ink drop discharge speed from the range "A", and the polarization level of the piezoelectric elements corresponding to these nozzles 131 is adjusted to the same level $b_n$ ($b_{+1}$=b50, $b_{+2}$=b45, $b_{-1}$=b75, $b_{-2}$=b100) for each group so that the ink drop discharge speed of the nozzles 131 in the group $G_n$ may fall within the range "A".

Figure 3:
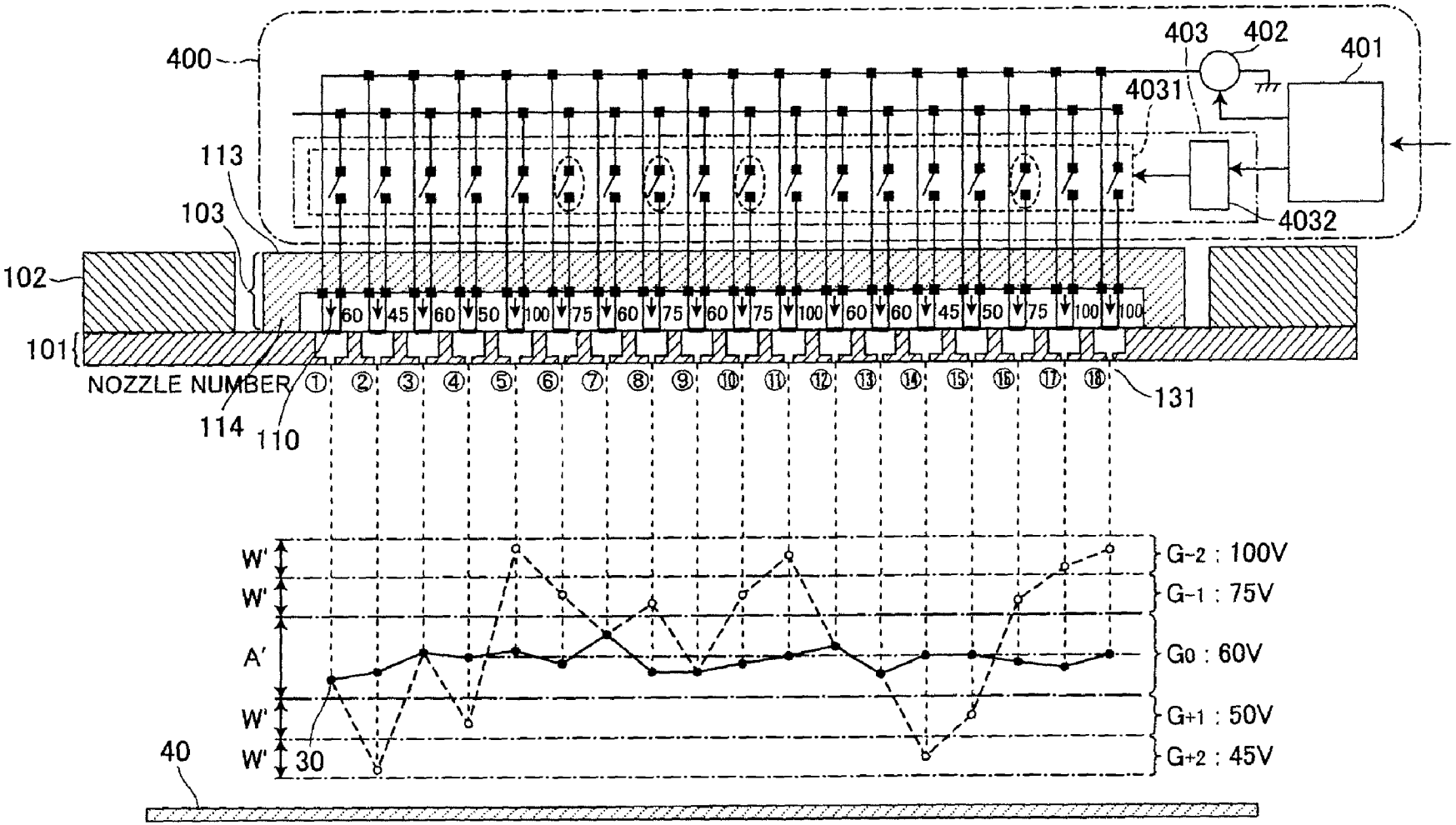
FIG. 3 is a configuration view for describing the configuration and operation of a repolarizing device in the first embodiment of the present invention.

FIG. 3 is a view showing a polarizing device 400 for polarizing the piezoelectric elements 110. The polarizing device 400 includes a polarization data generating circuit 401, a polarization voltage generating circuit 402 and a polarizing switching circuit 403. The polarization data generating circuit 401 receives polarization data from a host device not shown (for example, a personal computer) and controls the polarization voltage generating circuit 402 and the polarizing switching circuit 403 to turn ON polarizing switching elements 4031 connected to the nozzles 131 to be polarized. Thus, a predetermined magnitude of polarization voltage is applied to predetermined nozzles 131. In this manner, the piezoelectric elements 110 corresponding to the nozzles 131 belonging to the same group can be collectively polarized. The polarizing device 400 may be provided integrally with or separately from the recording device 1.

With reference to FIG. 1 and FIG. 4, the polarization of the piezoelectric elements 110 in this embodiment will be described. FIG. 4 is an explanation view of polarization of each piezoelectric element 110.

In FIG. 1, a dotted line extending from each nozzle 131 downward represents a flying trajectory of the ink drop 30. Circles located at the front ends of the dotted lines represent flying positions of the ink drops 30 after a lapse of a certain time period from the discharge from the nozzle 131. White circles represent flying positions of the ink drops 30 before polarization adjustment of the piezoelectric elements 110. Black circles represent flying positions of the ink drops 30 after polarization adjustment of the piezoelectric elements 110. The flying position is represented by only black circle, which means that the flying position of the ink drop 30 remains unchanged before and after polarization adjustment. The dotted line connecting the circles in the horizontal direction is a reference line for clarification of variations in the flying positions of the ink drops 30 before polarization adjustment and the solid line is a reference line for clarification of variations in the flying positions of the ink drops 30 after polarization adjustment.

Figure 4A:
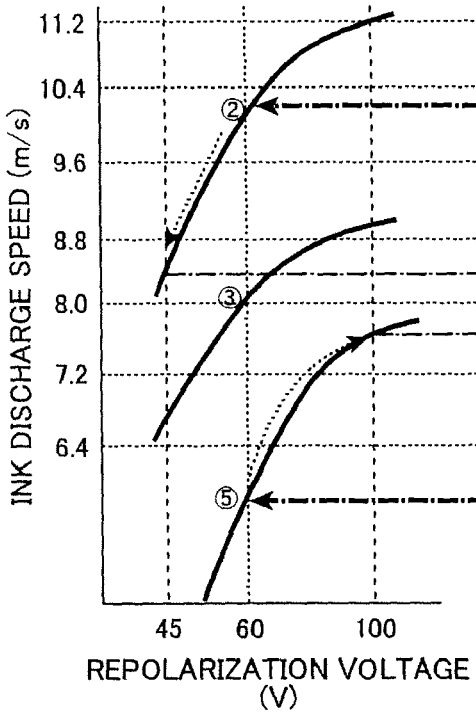
FIG. 4A is a graph showing ink drop discharge speed characteristics with respect to repolarization voltage in the first embodiment of the present invention.

FIG. 4A is a graph showing ink drop discharge speed characteristics with respect to repolarization voltage. A horizontal axis represents the repolarization voltage applied between the individual electrode 1122 and the common electrode 1121 of the piezoelectric element 110, and a vertical axis represents the ink drop discharge speed. The driving voltage of the piezoelectric elements 110 is kept as a predetermined voltage (25V) so that an average value of the ink discharge speed may be about 8 m/s.

Figure 4B:
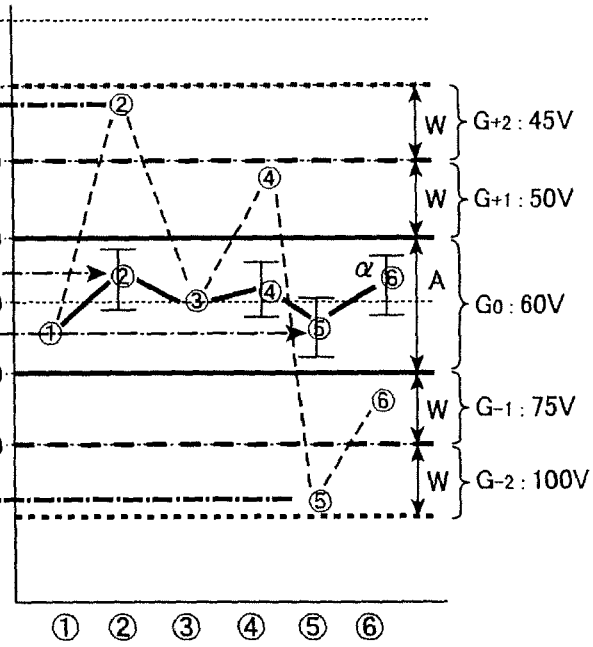
FIG. 4B is a graph showing an example of variation characteristics of ink discharge speed among nozzles in the first embodiment of the present invention.

FIG. 4B is a graph showing an example of variation characteristics of the ink discharge speed among the nozzles 131. A horizontal axis represents nozzle numbers and a vertical axis represents the ink discharge speed. The nozzle numbers in FIG. 4B correspond to five nozzles 131 from the left end of the recording head in FIG. 1, respectively. A dotted line connecting speed data plots of the nozzles 131 to each other in the horizontal direction is a reference line for clarification of variations in the ink discharge speed before polarization adjustment and the solid line is a reference line for clarification of variations in the ink discharge speed after polarization adjustment.

As apparent from FIGS. 4A and 4B, the ink discharge speed values before polarization adjustment vary centering on about 8 m/s. The discharge speed of the nozzle number 1 before polarization adjustment is about 7.5 m/s and the discharge speed of the nozzle number 3 before polarization adjustment is about 8.0 m/s. Since the values of the discharge speed are close to each other, the flying positions of the ink drops 30 in the discharging direction in FIG. 1 also become close to each other.

On the other hand, the discharge speed of the nozzle numbers 2 and 4 before polarization adjustment is faster than 9 m/s. For this reason, the flying positions of the ink drops 30 discharged from these nozzles 131 are located closer to a recording medium 40 than the flying positions of the ink drops 30 discharged from the nozzle numbers 1 and 3. On the contrary, the discharge speed of the nozzle numbers 5 and 6 is slower than 7.2 m/s. For this reason, the flying positions of the ink drops 30 discharged from these nozzles 131 are located closer to the nozzle 131 than the flying positions of the ink drops 30 discharged from the nozzle numbers 1 and 3.

Since the recording device 1 performs recording by allowing the ink drops 30 to land while moving recording medium 40 with respect to the recording head 10, recording quality deteriorates depending on variations in landing positions on the recording medium 40.

In this embodiment, a range of 20% centering on 8 m/s (±10%) is specified as the allowable range "A" of variations in the ink drop discharge speed in order to ensure the recording quality of the recording device 1. An allowable range "A'" of variations in the flying positions, that corresponds to the allowable range "A" of variations in the ink drop discharge speed (FIG. 1), is also determined.

In the nozzle numbers 1 to 6 in this embodiment, the nozzle numbers 1 and 3 fall within the ranges "A" ("A'"), the nozzle numbers 2 and 4 fall outside the ranges "A" ("A'") to the high speed side and the nozzle numbers 5 and 6 fall outside the range "A" ("A'") to the low speed side. As shown in FIG. 1, some nozzles 131 subsequent to the nozzle number 7 fall outside the allowable range "A" ("A'").

As shown in FIG. 4, for the nozzle number 2, for example, if the piezoelectric element 110 is once released its polarization, repolarized at 45 V under a polarization ambient temperature of 80° C., and then driven at a driving voltage of 25 V, the ink drop 30 is discharged at about 8.3 m/s. If the piezoelectric element 110 is once released its polarization, repolarized at 100 V, and then driven at a driving voltage of 25 V, the ink drop 30 is discharged at about 11.2 m/s.

Thus, by varying the polarization voltage from 45 V to 100 V when the driving voltage is 25 V, the ink drop discharge speed can be varied from 8.3 to 11.2 m/s. The ink drop discharge speed (about 10.2 m/s) at the repolarization at 60 V is almost equal to that before the repolarization. In other words, the polarization level at initial polarization is nearly equal to that at the repolarization at 60 V.

FIG. 4A also shows repolarization characteristics of the nozzle numbers 3 and 5. This confirms that the ink drop discharge speed can be adjusted by adjusting the repolarization voltage and that the polarization level at initial polarization is nearly equal to that at the repolarization at 60 V.

In consideration with the above-mentioned characteristics, in this embodiment, polarization adjustment is carried out as follows.

The piezoelectric elements 110 corresponding to the nozzles 131 that fall within the allowable range "A" (within "A'" in FIG. 1) (in this embodiment, the nozzles 1, 3, 7, 9, 12 and 13) are not repolarized. Alternatively, under a polarization ambient temperature of 80° C., for example, the piezoelectric elements 110 are polarized at a repolarization voltage 60V, which corresponds to the initial polarization state, and the polarization level $b_0$ is set as $b_0$=b60. Here, providing that the recording head 10 is assembled with the same components and by the same manufacturing process, the initial polarization state of the piezoelectric element 110 is almost same as that of the other piezoelectric elements 110. Therefore, in this embodiment, for example, if the repolarization voltage applied to the nozzle number 1 is 60 V, the nozzle numbers 3, 7, 9, 12 and 13 are also repolarized at 60 V. It is unnecessary to measure the repolarization voltage for each nozzle.

Next, adjustment of the piezoelectric elements 110 corresponding to the nozzles 131 that fall outside the allowable range "A" ("A"') will be described.

First, the nozzles 131 that fall outside the allowable range "A" are divided into a plurality of groups depending on the magnitude of deviation from the allowable range "A" of variations in the ink drop discharge speed. In this embodiment, as shown in FIG. 4, the nozzles are grouped as follows: a group of nozzles that deviates by 10 to 20% from 8 m/s on the high-speed side is defined as $G_{+1}$, a group of nozzles that deviates by 20 to 30% from 8 m/s on the high-speed side is defined as $G_{+2}$, a group of nozzles that deviates by 10 to 20% from 8 m/s on the low-speed side is defined as $G_{-1}$ and a group of nozzles that deviates by 20 to 30% from 8 m/s on the low-speed side is defined as $G_{-2}$.

The piezoelectric elements 110 corresponding to the nozzle numbers 4 and 15 in the group $G_{+1}$ are polarized at a repolarization voltage of 50 V to adjust the polarization level $b_{+1}$ to b50. The piezoelectric elements 110 corresponding to the nozzle numbers 2 and 14 in the group $G_{+2}$ are polarized at a repolarization voltage of 45 V to adjust the polarization level $b_{+2}$ to b45. The piezoelectric elements 110 corresponding to the nozzle numbers 6, 8 and 10 in the group $G_{-1}$ are polarized at a repolarization voltage of 75 V to adjust the polarization level $b_{-1}$ to b75. The piezoelectric elements 110 corresponding to the nozzles 5, 11, 17 and 18 in the group $G_{-2}$ are polarized at a repolarization voltage of 100 V to adjust the polarization level $b_{-2}$ to b100.

For example, the nozzle number 2 belonging to the group $G_{+2}$ is repolarized at 45 V. As apparent from FIG. 4A, when the nozzle number 2 is repolarized at 45 V, the ink drop discharge speed from the nozzle number 2 can be decreased from about 10.2 m/s to about 8.3 m/s. That is, the ink drop discharge speed can be decreased by about 25% from 8 m/s. The nozzle number 5 belonging to the group $G_{-2}$ is repolarized at 100 V. When the nozzle number 5 is repolarized at 100 V, the ink drop discharge speed from the nozzle number 5 can be increased from about 5.7 m/s to about 7.7 m/s. That is, the ink drop discharge speed can be increased by about 25% from 8 m/s. In this manner, the ink drop discharge speed from each nozzle 131 can be adjusted to fall between the allowable range "A".

Figure 5:
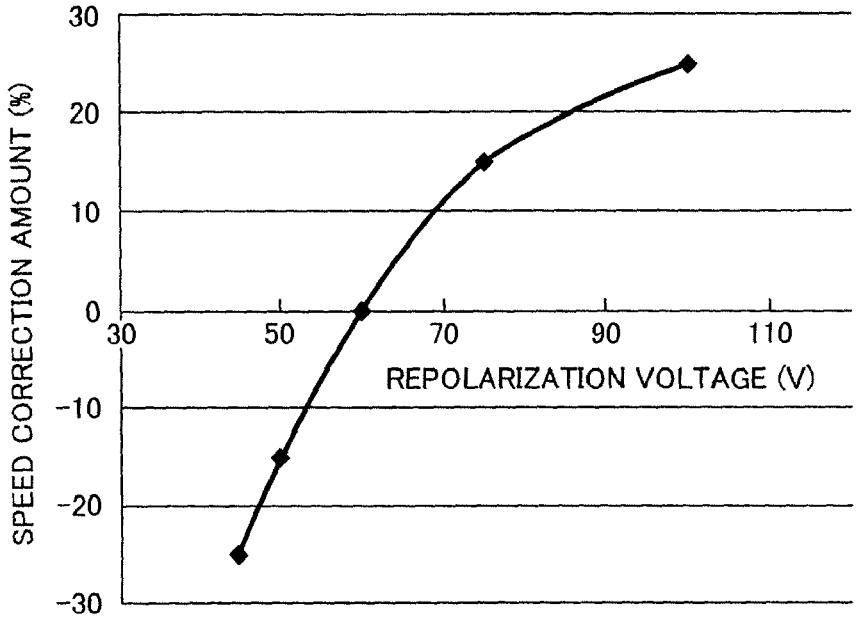
FIG. 5 is a graph showing adjustment characteristics of ink drop discharge speed through repolarization adjustment of the recording head in the first embodiment of the present invention.

FIG. 5 is a graph showing relationship between the repolarization voltage and correction amount of the ink drop discharge speed. In the recording head 10 in this embodiment, the ink drop discharge speed with respect to the repolarization voltage can be decreased by about 25% at a repolarization voltage of 45 V and by about 15% at 50V from 8 m/s, and can be increased by about 15% at 75 V and by about 25% at 100 V from 8 m/s. As described above, when the piezoelectric element 110 is repolarized at a repolarization voltage of 60 V, the ink drop discharge speed from the nozzle 131 corresponding to the piezoelectric element 110 is almost the same as the speed in the initial state. Utilizing this feature, the ink drop discharge speed from the nozzle numbers 4 and 6 can be adjusted to be within the allowable range "A". Polarization level adjustment values of the piezoelectric elements 110 determined on the basis of the above-mentioned polarization adjustment are described next to the piezoelectric elements 110 in FIG. 1.

However, even when the repolarization adjustment is performed by applying the same voltage to each piezoelectric element 110 of a plurality of nozzles 131 having the same discharge speed with the polarization level $b_0$, the actual ink drop discharge speed varies from a target ink drop discharge speed. Variations a by which the ink drop discharge speed can vary from the target ink drop discharge speed are shown in FIG. 4B.

It is found by experiments that the variation "α" caused by variations due to individuality of the recording head 10 and nozzle 131, and reproducibility of repolarization, etc. falls within the range of about 8 m/s.+−.5%, if the recording head 10 with the same configuration and specification is assembled with the same components and by the same manufacturing process. In this embodiment, relationship between the variation "α" and the allowable range "A" is set so as to A>α. Width "W" that indicates deviation of each group from the variation allowable range "A" is set so as to W≦(A−α). For example, in this embodiment, it is set as α=10% (.+−.5%), A=20% (.+−.10%) and W=10%.

Thus, even when the slowest ink drop discharge speed among the group $G_{+1}$ is decreased at a maximum, that is, the slowest ink drop discharge speed (+10%) is decreased by 15% through polarization adjustment and by 5% through the variation "α", the ink drop discharge speed is decreased by 10(−10=10−15−5)% from the reference speed 8 m/s and falls within the allowable range "A"=20% (±10%). Even when the fastest ink drop discharge speed among the group $G_{+1}$ is decreased at a minimum, that is, the fastest ink drop discharge speed (+20%) is decreased by 15% through polarization adjustment and increased by 5% through the variation "α", the ink drop discharge speed is increased by 10(10=20−15+5)% from the reference value 8 m/s and falls within the allowable range "A"=20% (±10%). Similarly, all nozzles 131 in the other groups fall within the allowable range "A"=20% (+10%). FIG. 1 shows the state where the flying positions of ink drops discharged from all nozzles 131 fall within the range "A"' through this adjustment and that variations in the ink discharge speed are greatly improved.

When the recording head 10 in this embodiment is manufactured in this manner, time and effort necessary for polarization adjustment can be greatly reduced for the following reasons. First, since the piezoelectric elements 110 corresponding to nozzles 131 forming an arbitrary group can be polarized at one time by collectively applying the same repolarization voltage thereto, polarization adjustment can be finished for a short time.

For example, when the nozzles 6, 8, 10 and 16 forming the group $G_{-1}$ are collectively polarized as shown in FIG. 3, polarizing switching elements 4031 connected to the nozzles 6, 8, 10 and 16 are closed and a polarization voltage of 75 V is applied to the nozzles 6, 8, 10 and 16. Thereby, since the piezoelectric elements 110 corresponding to the nozzles 6, 8, 10 16 can be collectively polarized, repolarization processing is finished much faster than the case where polarization voltage is individually applied to each piezoelectric element 110 as conventional. Furthermore, it is possible to omit repolarization of the nozzles in the group $G_0$ within the allowable range "A" of the ink drop discharge speed. Thus, the number of nozzles to be subjected to polarization adjustment can be greatly reduced and thus, time and effort for polarization adjustment of the whole head can be greatly reduced.

Second, time and effort necessary for determining appropriate adjustment voltage value for repolarization can be greatly reduced. In other words, if one recording head has the same configuration and specification as another recording head, the discharge speed characteristic of one recording head is same as that of another recording head that has been determined for one recording head. Thus, since data on discharge speed characteristics with respect to the polarization level as shown in FIG. 5 is collected in advance, it is not necessary to determine the discharge speed characteristic with respect to another recording heads. Since an appropriate adjustment voltage value for repolarization is determined based on the data, time and effort can be greatly reduced.

In the above-mentioned embodiment of the present invention, the nozzles 131 are divided into five groups. However, the number of groups is not limited to five. As the width of the group is smaller and the number of groups is larger, adjustment accuracy can be improved. As the width of the group is larger and the number of groups is smaller, time and effort for polarization adjustment can be reduced more.

Figure 6:
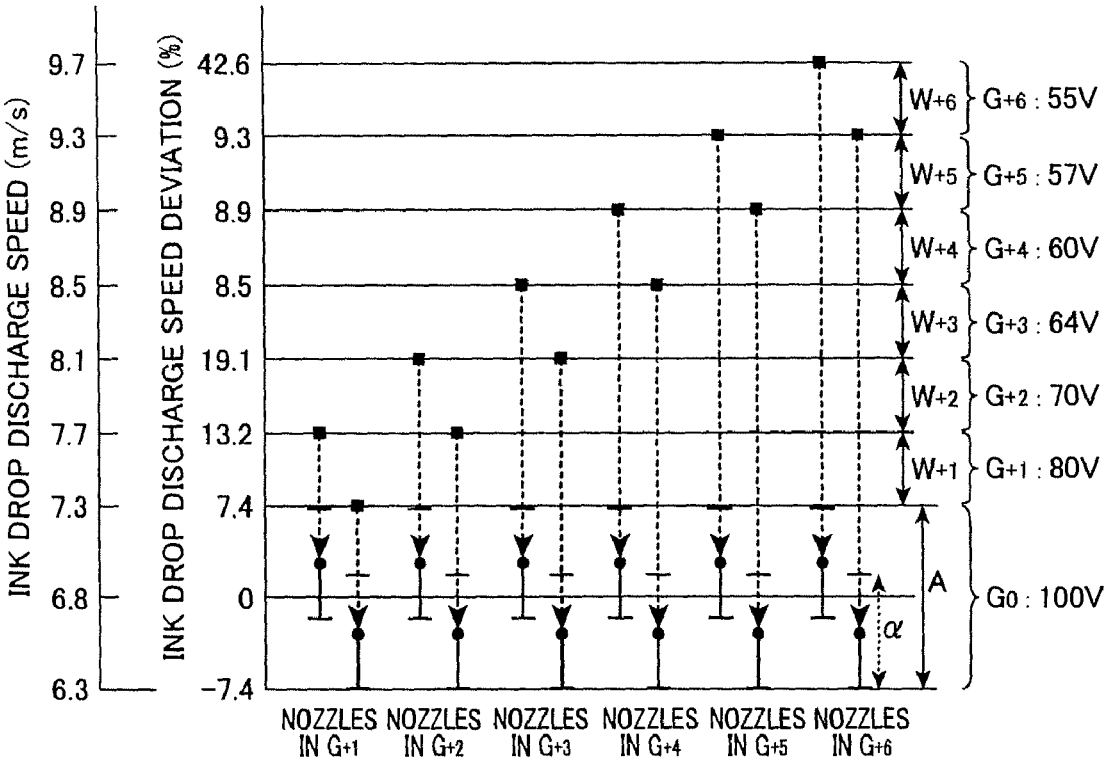
FIG. 6 is a view for describing a modified example of repolarization adjustment of the recording head in a second embodiment of the present invention.

Next, a second embodiment of the present invention will be described with reference to FIG. 6 and FIG. 7. FIG. 6 is a view for describing a repolarization adjustment in the second embodiment. The present embodiment is different from the first embodiment in the directions of accelerating and decelerating the ink drop discharge speed by repolarization adjustment. The piezoelectric elements 110 in the present embodiment are adjusted so that the ink drop discharge speed only decelerates, while the piezoelectric elements 110 are adjusted in the first embodiment so that the ink drop discharge speed both accelerates and decelerates. In other words, the target ink discharge speed is set at an ink discharge speed of the nozzle 131 whose ink discharge speed is the slowest in all of the nozzles 131. Hereinafter, polarization adjustment of the piezoelectric elements 110 will be described in the case where the target ink discharge speed is 6.8 m/s when the piezoelectric elements 110 are driven at 23 V.

Figure 7:
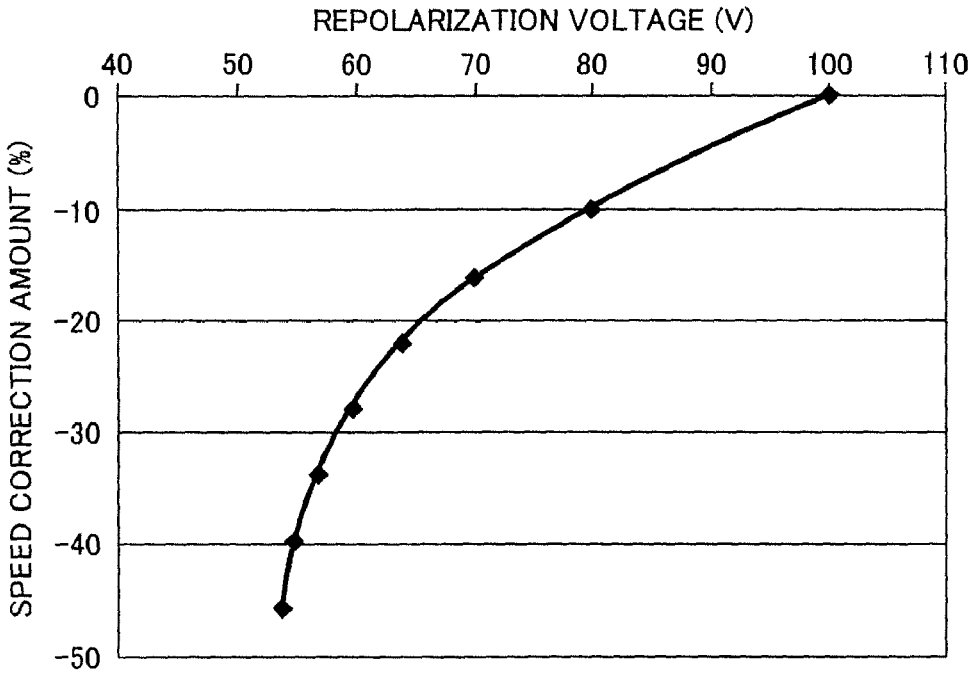
FIG. 7 is a graph showing adjustment characteristics of the ink drop discharge speed through repolarization adjustment of the recording head in the second embodiment of the present invention.

FIG. 7 shows measurement results of polarization adjustment, that is, deceleration and acceleration level of ink drop discharge speed with respect to repolarization voltage at normal temperatures. When a repolarization voltage is 100 V, the speed adjustment amount becomes 0, which corresponds to the polarization level at initial polarization. When the recording head 10 can be subjected to repolarization adjustment at normal temperatures, application of a voltage of 100 V or more may cause a problem in terms of the withstand voltage of the piezoelectric elements 110. For this reason, in the present embodiment, only deceleration adjustment at 100 V or less is performed.

If one recording head has the same configuration and specification as another recording head 10, both of the recording heads have almost the same characteristics as shown in FIG. 7. In this embodiment, the variation "$\alpha$" is set as 8.8% (.+−.4.4%), the allowable range "A" is set from 6.3 to 7.3 m/s, that is, as 14.8% (.+−.7.4%), and the width "W" is set as 6% so as to meet $A>\alpha$ and $W\leqq(A-\alpha)$. As shown in FIG. 6, the nozzles 131 of the recording head 10 are divided into groups $G_0$ to $G_6$.

Subsequently, an adjustment deceleration value $V_{+n}$ for the group $G_{+n}$ required in order to fall the fastest ink drop discharge speed among the group $G_{+n}$ within the allowable range "A" is acquired according to the following equation: $V_{+n}$=(the highest speed in $G_{+n}$)−A/2+$\alpha$/2. Accordingly, for example, "$V_{+1}$" becomes 10.2 (13.2−14.8/2+8.8/2)%. Since a repolarization voltage for decreasing the speed by 10.2% is found to be 80 V as shown in FIG. 7, piezoelectric elements 110 corresponding to the nozzles 131 in $G_{+1}$ are polarized at a repolarization voltage of 80V. Similarly for the other groups $G_{+2}$ to $G_{+6}$, the repolarization voltage and the polarization level are set as shown in FIG. 6. Thereby, the ink drop discharge speeds from all nozzles 131 can fall within the allowable range 6.3 to 7.3 m/s. Further, since the recording head 10 can be subjected to repolarization adjustment at normal temperatures, manufacturing is facilitated and productivity is also improved.

Figure 8:
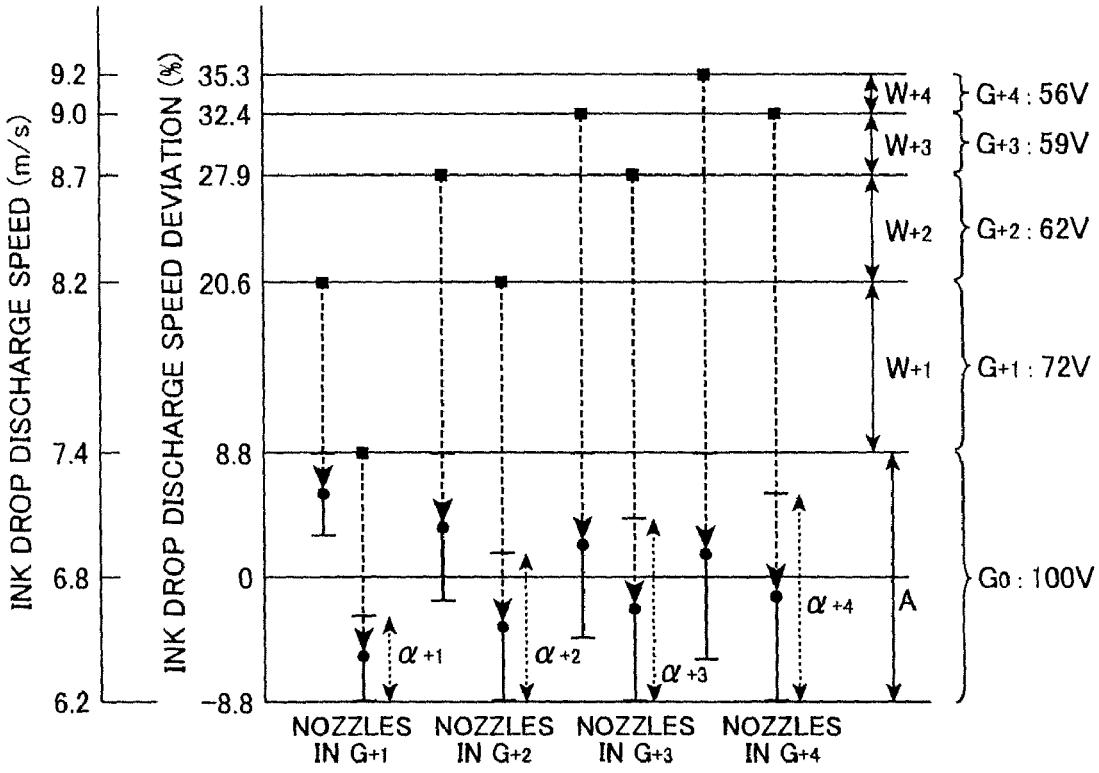
FIG. 8 is another modified example of repolarization adjustment of the recording head in a third embodiment of the present invention.

Next, a third embodiment of the present invention will be described with reference to FIG. 8. FIG. 8 is a view for describing the third embodiment. The present embodiment is different from the above-mentioned embodiments in that the ink drop speed deviation width "W" varies depending on the group of nozzles 131. It is possible that the variations "$\alpha$" becomes larger as the polarization adjustment amount is increased. Thus, the width "W" becomes smaller as the groups deviate from the allowable range "A" in the present embodiment. Given that the variations in the ink drop discharge speed adjustment amount with respect to $G_n$ is defined as $\alpha_n$ (in this embodiment, $\alpha_{+1}$, $\alpha_{+2}$, $\alpha_{+3}$, and $\alpha_{+4}$ are set at 5.8%, 10.3%, 13.1% and 14.7% respectively), since the width "$W_n$" must be equal to or smaller than ($\alpha-\alpha_n$), maximum values of "$W_{+1}$" of $G_{+1}$, "$W_{+2}$" of $G_{+2}$, "$W_{+3}$" of $G_{+3}$ and "$W_{+4}$" of $G_{+4}$ become 11.8 (=17.6−5.8)%, 7.3 (=17.6−10.3)%, 4.5 (=17.6−13.1)% and 2.9 (=17.6−14.7)% respectively.

By assigning the width "$W_n$" and the variation "$\alpha_n$" to the following equation: $V_{+n}$=(the highest speed in $G_{+n}$)−A/2+$\alpha$/2, a required adjustment deceleration value "$V_{+n}$" is obtained. The repolarization voltage for each group is obtained from FIG. 7. As shown in FIG. 8, the repolarization voltage and the polarization level are set. Thereby, all nozzles 131 can fall within the allowable range 6.2 to 7.4 m/s of variations in the ink drop discharge speed of the nozzles in the recording head.

In this embodiment, since a lot of nozzles can be simultaneously subjected to repolarization adjustment by reducing the number of groups while ensuring adjustment accuracy, the productivity of the recording head can be improved. In the above-mentioned embodiments, the on-demand ink jet recording head according to so-called push-type piezoelectric element system is used. However, an on-demand ink jet recording head having the configuration in which plate-like piezoelectric elements are formed on a diaphragm face, that is, according to so-called bend-type piezoelectric element system, may be used.

In the above-mentioned embodiments, the ink drop discharge speed is adjusted through polarization adjustment. However, it is well-known that the ink drop discharge amount can be also adjusted by adjusting the repolarization voltage. Therefore, in an embodiment in which the ink drop discharge speed in the above-mentioned embodiments is replaced with the ink drop discharge weight, similarly, the ink drop discharge weight can be adjusted with less time and effort and a recording head with small variations in the ink drop discharge weight can be manufactured with high productivity.

While the invention has been described in detail with reference to the specific embodiment thereof, it would be apparent to those skilled in the art that various changes and modifications may be made therein without departing from the spirit of the invention.

What is claimed is:

1. A method for manufacturing an inkjet recording head including a plurality of nozzles and a plurality of piezoelectric elements provided in one-to-one correspondence with the plurality of nozzles, each piezoelectric element expanding and contracting in accordance with a driving voltage applied thereto and polarizing during manufacturing in accordance with a polarizing voltage applied to thereto, the method comprising:

ejecting test ink droplets and print ink droplets from the nozzles;

measuring ejection results of the test ink droplets;

dividing the plurality of nozzles into a plurality of groups based on the ejection results; and applying a group-based polarizing voltage determined for each group to the piezoelectric elements belonging to a corresponding group to polarize the piezoelectric elements so that ejection results of the print ink droplets fall in a predetermined range.

2. The method according to claim 1, wherein application of the group-based polarizing voltage to the piezoelectric elements is performed en bloc.

3. The method according to claim 1, further comprising:

finding a characteristic of one of the plurality of nozzles that indicates a variation of the ejection result relative to the polarizing voltage; and determining the group-based polarizing voltage based on the characteristic.

4. The method according to claim 1, further comprising:

finding a characteristic of a nozzle equivalent to the nozzle provided in the inkjet recording head, the characteristic indicating a variation of the ejection result relative to the polarizing voltage; and determining the group-based polarizing voltage based on the characteristic.

5. The method according to claim 1, wherein the polarizing step is dispensed with for the piezoelectric elements belonging to a group in which the ejection results have fallen in the predetermined range.

6. The method according to claim 1, wherein the dividing step divides the plurality of nozzles into a plurality of groups based on an ejection speed of the test ink droplet.

7. The method according to claim 6, wherein only the group-based polarizing voltage for decreasing or maintaining the ejection speed is applied to the piezoelectric elements.

8. The method according to claim 1, wherein each group has a range of the ejection result deviating from the predetermined range, the range of the ejection result decreasing as the deviation increases.

9. The method according to claim 1, wherein "A" and "$\alpha$" are set so as to meet $A>\alpha$, wherein "A" indicates the predetermined range and "$\alpha$" indicates a deviation of an ejection result of the print ink droplet from a target value.

10. The method according to claim 9, wherein "A", "$\alpha$" and "W" are set so as to meet $W \leqq (A-\alpha)$ wherein "W" indicates a range of the ejection result deviating from the predetermined range.

* * * * *